United States Patent [19]

Tsakiris

[11] 4,455,798

[45] Jun. 26, 1984

[54] SKYLIGHT SYSTEM

[75] Inventor: Nicholas G. Tsakiris, South Berwick, Me.

[73] Assignee: Wasco Products, Inc., Sanford, Me.

[21] Appl. No.: 299,315

[22] Filed: Sep. 4, 1981

[51] Int. Cl.[3] ..... E04B 7/18

[52] U.S. Cl. ..... 52/200; 52/665; 403/405; 403/174

[58] Field of Search ..... 52/665, 200, 460, 461, 52/464, 463, 466, 467, 468, 469; 403/405, 187, 174

[56] References Cited

U.S. PATENT DOCUMENTS

| | | | |
|---|---|---|---|
| 3,144,265 | 8/1964 | Hamble | 403/405 |
| 3,791,088 | 2/1974 | Sandow | 52/200 |
| 3,844,087 | 10/1974 | Schultz | 52/200 |
| 3,899,258 | 8/1975 | Mathews | 52/656 |
| 4,047,348 | 9/1977 | McSweeney | 403/178 |
| 4,114,330 | 9/1978 | Sakolics | 52/200 |

FOREIGN PATENT DOCUMENTS

| | | | |
|---|---|---|---|
| 2143160 | 3/1971 | Fed. Rep. of Germany | 52/665 |

*Primary Examiner*—Henry E. Raduazo

*Attorney, Agent, or Firm*—Wolf, Greenfield & Sacks

[57] ABSTRACT

A skylight structure having a condensate removal system and constructed employing rafters and purlins in interconnecting relationship. The rafters have side condensation gutters formed by an upright wall upon which ends of adjacent purlins rest. The purlins rest upon the upright wall of the rafter. Adjacent purlins are secured by means of a purlin locating clip secured to the center support of the rafter and having side extending wings each engaging in a respective purlin groove.

24 Claims, 12 Drawing Figures

20
3
3
18C
44
11
2
16
16
18
18
22
18B
2
12
4
14
28
46
10
4

SKYLIGHT SYSTEM

BACKGROUND OF THE INVENTION

The present invention relates in general to a skylight structure, and more particularly, a skylight system employing interconnected rafters and purlins adapted to support single or double glazing panels. The basic framework of this structure may be constructed of a metal such as aluminum although the preferred system described herein is a sloped glazing system. It is understood that the principles of the invention may be applied in constructing systems of varied configuration.

In this general field representative patents are U.S. Pat. Nos. 3,844,086 and 3,844,087. It is the general purpose of the present invention to provide a skylight system that is generally of simpler construction than those found in the prior art, which can be assembled quite readily, and which is essentially maintenance free. It is in particular an object of the present invention to provide a skylight system wherein the purlins and rafters and their interconnections are constructed more simply.

Another object of the present invention is to provide a skylight system that readily adapts itself to constructing systems in different sizes and of different shape and configuration.

Another object of the present invention is to provide an improved skylight system having condensation gutters integral therewith and which can readily accommodate either single or double glazing.

SUMMARY OF THE INVENTION

To accomplish the foregoing and other objects of this invention, there is provided a skylight system in the form of a rigid structural framework comprised of a plurality of rafters and purlins with the rafters being supported in generally parallel spaced relationship with individual purlins extending between these adjacently spaced rafters and means being provided for retaining the purlins in fixed position relative to the rafters. The skylight system may be constructed in many different forms and in the one described in detail hereinafter it is in a simple sloped construction. Other multiple sloped configurations may also be adopted. The structural framework is meant to hold glazing panels which may be of square or rectangular shape. Means are provided for securing the glazing panels in position between the spaced rafters and purlins. Preferably both rafters and purlins have condensation gutters. The rafters have opposite side upright walls which in part form the elongated condensation gutters on either side of each rafter. The upright walls of the rafters remain unnotched with the purlins simply resting upon these upright walls. The purlins are retained in position by retaining means such as a locating clip held to the rafter at the intersection with the purlins and engaged with the purlins to position and interlock the purlins in the proper position relative to the rafters. The glazing panels may be either of single panel or double insulated panel construction. The rafters are preferably of extruded metal construction such as extruded aluminum, are hollow, have a generally O-shaped or tubular appearance and include a centrally disposed glazing support flange having a top support surface which is disposed above the condensation gutters. The purlins on the other hand are of generally I-shape having a lower condensation gutter and also having thereabove a centrally disposed glazing support flange having a glazing support surface at the top thereof. The purlins each have a length on the order of the spacing between rafters and are of an extruded metal construction, such as extruded aluminum. With regard to the rafter, there is provided an elongated gasket arranged between the glazing support flange top surface and the glazing panel. The top surface of the glazing support flange may also have a pair of elongated grooves to receive the locating clip with the locating clip being held to the rafter by a bolt secured to the rafter or a like fastening arrangement. There are described herein, two different versions of the locating clip. In one version, the locating clip is cross-shaped having a first set of legs in line and received in the elongated groove of the rafter, and a second set of legs also in line but extending orthogonally to the first set of legs and received in elongated grooves in respective adjacently disposed purlins. Both purlins and rafters also have elongated channels for receiving gaskets for sealing between the rafters (purlins) and the glazing panels. In the other version of the locating clip, it is constructed in the form of a pin adapted to be received in a transverse channel of the rafter at a position therealong wherein the purlin is to be located. This locating pin extends through the transverse channel out either side thereof for interlocking at opposite ends with adjacent purlins disposed on either side of the rafter.

BRIEF DESCRIPTION OF THE DRAWINGS

Numerous other objects, features and advantages of the invention become apparent upon a reading of the detailed description taken in conjunction with the accompanying drawings, in which.

DETAILED DESCRIPTION

Figure 1:
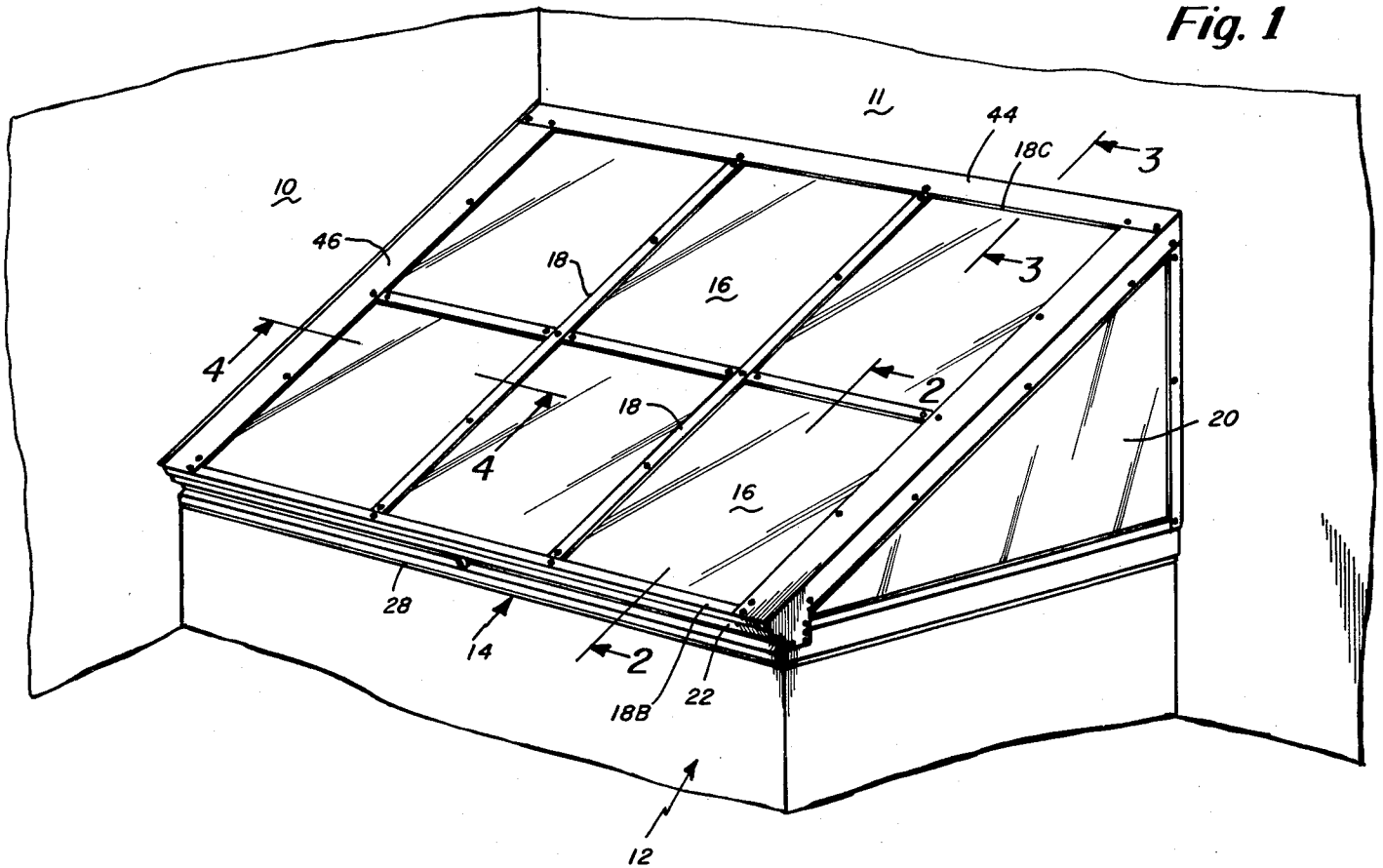
FIG. 1 is a perspective view showing a skylight system constructed in accordance with the principles of the present invention.

Referring now to the drawings, and in particular FIG. 1, there is shown a skylight system constructed in accordance with the principles of the present invention. This particular system is a simple configuration of sloped type. However, it is understood that the shape and size of the system can be of many different types.

In FIG. 1 the skylight system is disposed between walls 10 and 11 and is disposed upon the base 12. The skylight system comprises a framework 14 which is shown in more detail in FIGS. 2–8. The framework supports glazing panels 16. These panels are held in place by retainers 18 also discussed and shown in more detail in FIGS. 2–8. There may also be provided a side panel 20 as indicated in FIG. 1.

Figures 2, 3:
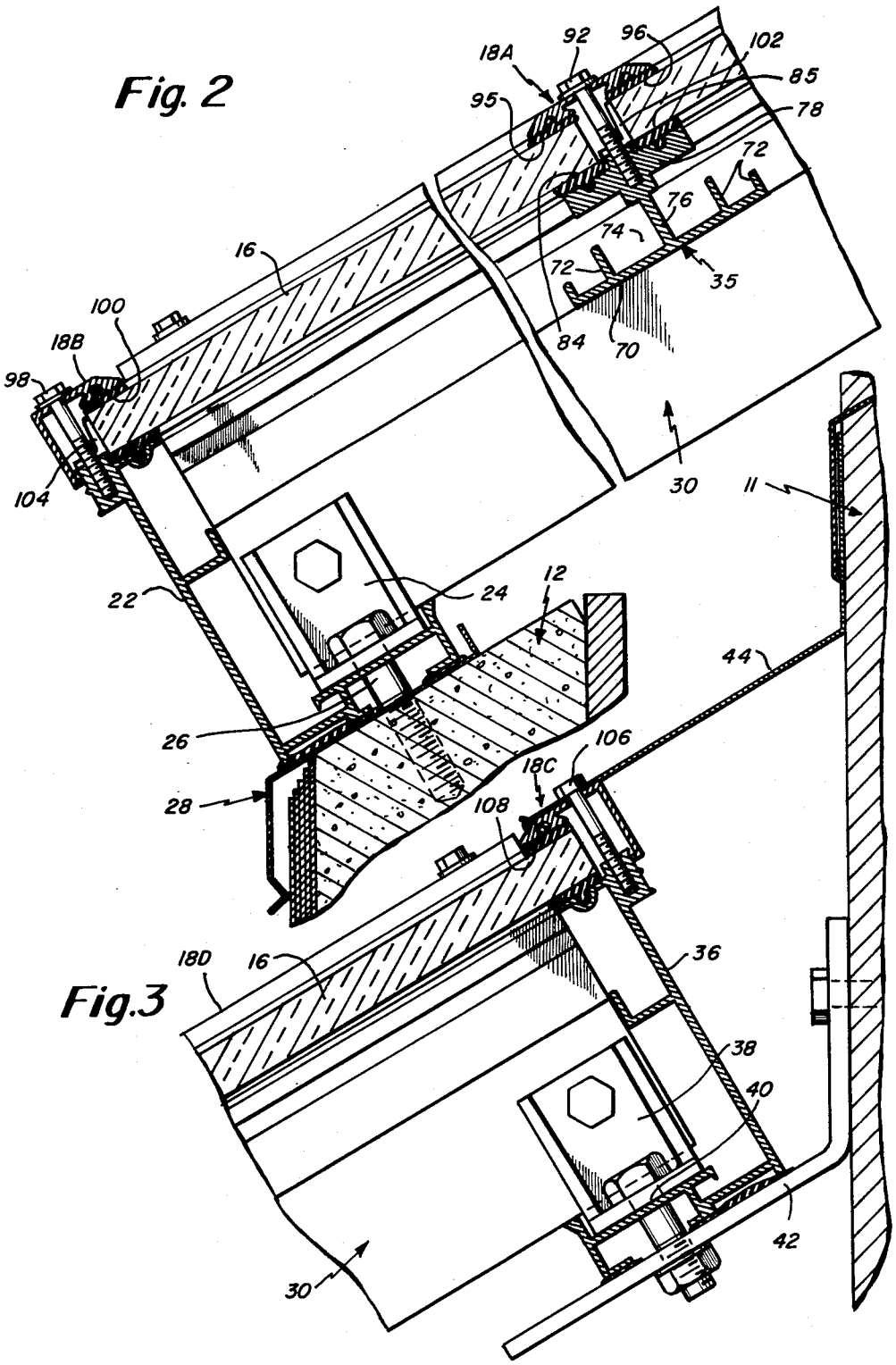
FIG. 2 is a cross-sectional view through the skylight system of FIG. 1 as taken along line 2—2 of FIG. 1.
FIG. 3 is a further cross-sectional view taken also through the perspective view of FIG. 1 at a top section of the skylight system and as taken along line 3—3 of FIG. 1.

FIG. 2 is a cross-sectional view taken along line 2—2 of FIG. 1 and shows the part of the framework that secures to the base 12. This includes an extruded metal sill 22, along with a bracket 24. Bolts 26 secures this part of the framework to the concrete base 12. If necessary, a sleeve may be used between the bolt and the concrete with the concrete being drilled to receive the sleeve and the sleeve then accommodating the bolt. As indicated in FIG. 2 there is also provided flashing 28 which may be in the form of a preformed aluminum sheet.

Figure 6:
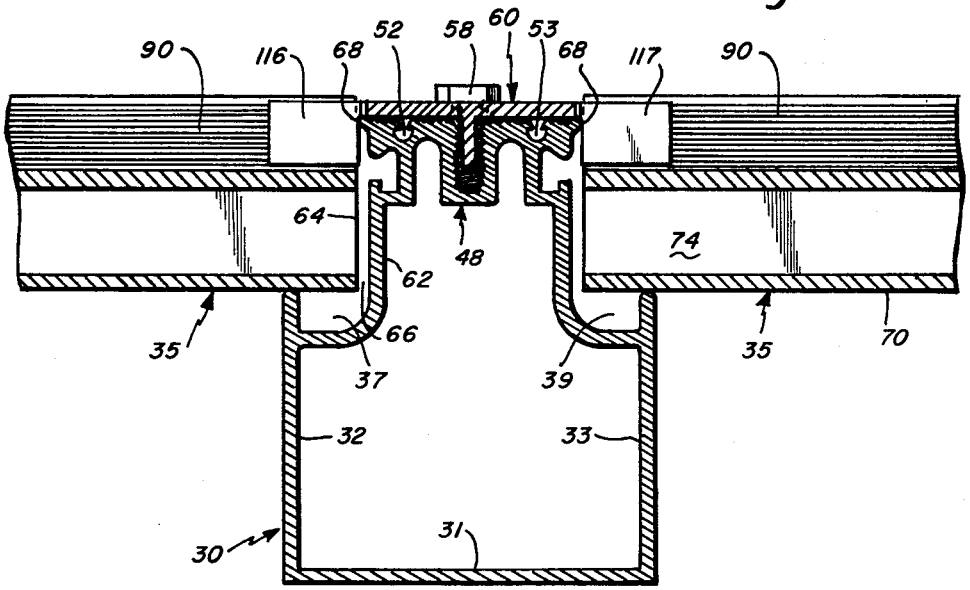
FIG. 6 is a cross-sectional view similar to that shown in FIG. 4 but with the cross-section being taken at the rafter and purlin intersection.
Figure 8:
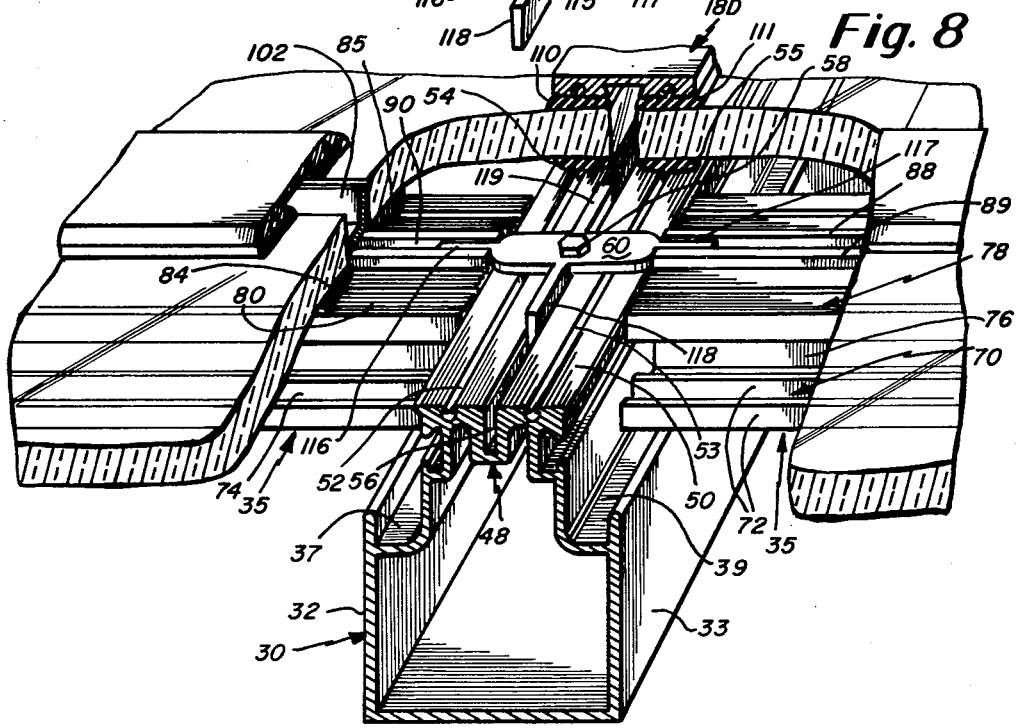
FIG. 8 is a perspective view with part of the glazing cut away and in particular showing the skylight construction at the intersection between a rafter and a pair of adjacently disposed purlins.

The framework also basically comprises a plurality of rafters 30 and a plurality of purlins 35 which interconnect as described hereinafter between adjacent rafters. FIGS. 6 and 8 clearly show the interconnecting relationship between the rafters 30 and the purlins 35.

FIG. 3 is a cross-sectional view taken along line 3—3 of FIG. 1 at a top end of the skylight system. This also shows the top end of a rafter 30 held in contact with the extruded header 36. The header 36 as noted is of very similar cross-sectional construction to the sill 22. The header has associated therewith a bracket 38 and associated bolts 40 for securing the rafter and header to an angular bracket 42 supported from the upright wall 11. There is also associated with the top of the skylight construction, a piece of flashing 44 as noted in FIG. 3.

Figure 4:
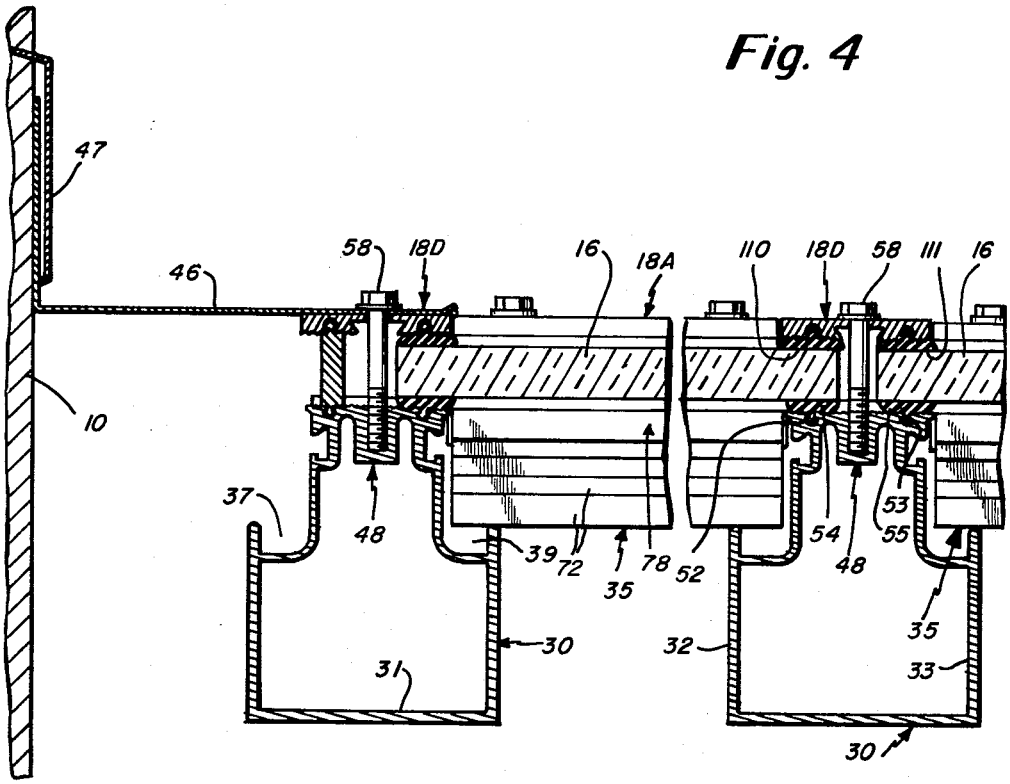
FIG. 4 is another cross-sectional view taken orthogonally to the views of FIGS. 2 and 3 as taken along line 4—4 of FIG. 1.
Figure 7:
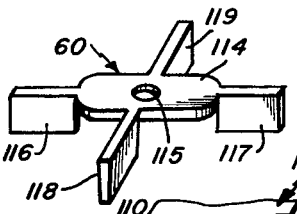
FIG. 7 is a perspective view of one version of the locating clip of the present invention.

FIG. 4 is a cross-sectional view taken along line 4—4 of FIG. 1 and showing the general construction on the side of the skylight system. Thus, there is shown in FIG. 4 a flashing 46 which extends to the upright wall 10 and interlocks with flashing 47. FIG. 4 particularly shows the construction of the rafters 30, each being of hollow (tubular) construction. Both rafters and purlins are preferably constructed of an extruded aluminum. Each rafter has a base wall 31 and a pair of oppositely disposed upright side walls 32 and 33 which terminate at top ends above formed condensation gutters 37 and 39, respectively. At the top of each rafter there is provided a glazing support flange 48 having a top flat support surface 50. Along the surface 50 extend a pair of elongated slots 52 and 53 for accommodating cupped gaskets 54 and 55, respectively. There is also disposed intermediate the slots 52 and 53, a deeper elongated groove 56 into which bolts may extend such as the securing bolt 58 for securing the locating clip 60 the details of which are discussed hereinafter. The locating clip 60 is shown in FIGS. 6–8 and in perspective view in particular in FIG. 7. The deep groove 56 receives part of the locating clip 60.

The rafter is also constructed so as to assure a proper minimum spacing between, for example, the rafter wall 62 shown in FIG. 6 and the end 64 of the purlin. This is identified in FIG. 6 by the gap 66. This gap is assured by providing a slight shoulder 68 on opposite sides of the upper support flange 48 of the rafter. With this shoulder the purlin is prevented from making direct contact with the wall 62 of the rafter. The shoulder appears on both sides of the rafter and thus contact is also prevented on the opposite side above the condensation gutter 39 of FIG. 6.

Figure 5:
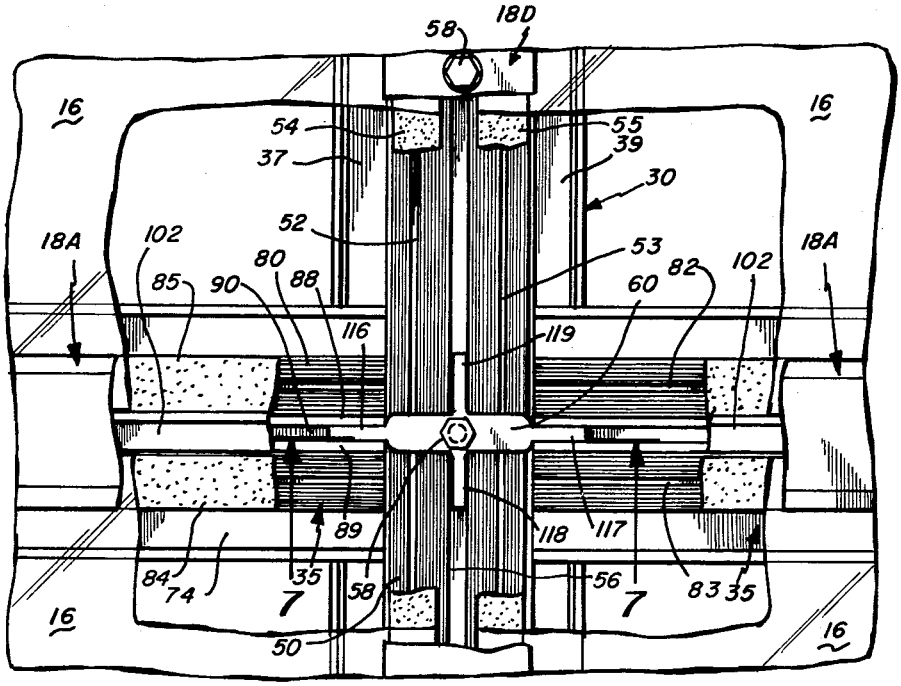
FIG. 5 is an orthogonal plan view with the glazing cut away and particularly showing the intersection between a rafter and adjacent purlins.

FIGS. 2, 5 and 8 illustrate the construction of the purlins 35. Each purlin is of relatively short length extending between adjacently spaced rafters. The purlin comprises a base 70 representing the widest portion of the purlin and having extended up therefrom a series of ribs 72 which form condensation gutters 74 extending along each purlin. FIG. 6 clearly indicates the interrelationship between the purlin gutter 74 which may carry condensation to the rafter gutter 37 or 39. Longitudinally along the center of the base 70 there is provided the intermediate support wall 76 which terminates in the top support member 78. As noted in FIG. 2, the purlin has a somewhat I-shape cross-section. The top support member 78 has a top support surface 80 having elongated slots 82 and 83 for accommodating cup-shaped gaskets 84 and 85, respectively. FIG. 2 shows the gaskets in position on the surface 80 of the support member 78.

The top support surface 80 of the member 78 also has elongated short walls 88 and 89 between which is defined the groove 90 into which bolts may extend such as the securing bolt 92 shown in FIG. 2. Also, the groove is for receiving a part of the clip 60 such as shown in FIG. 8 and discussed in more detail hereinafter.

In FIG. 1 the reference character 18 generally identified retainers that are used in association with the system. In the more detailed views of FIGS. 2–8 retainers of different configuration are shown. For example, in FIG. 2 there is shown a retainer 18A used in association with the purlins. The retainer 18A is secured by the bolt or series of bolts 92 and supports gaskets 95 and 96. Each of these gaskets are for sealing against one of the glazing panels 16. Also noted in FIG. 2 is a second type of retainer 18B and associated bolt 98 and gasket 100 associated with the sill 22.

In order to prevent the glazing panels from shifting and possibly contacting the bolts such as bolts 92 and 98 in FIG. 2, there is provided a stop 102 associated with bolt 92 and a stop 104 associated with bolt 98. These stops are captured by their respective bolts and assist in positioning the glazing panels in preventing their contact with the bolts.

FIG. 3 shows still another form of retainer 18C and associated bolt 106 and gasket 108. This retainer is associated with the header 36. FIG. 4 shows still a further form of retainer 18D associated with each rafter. The retainer receives one of the series of securing bolts 58 which extends into the top section of the rafter 30. The retainer 18D supports respective gaskets 110 and 111 for sealing against adjacently disposed glazing panels 16.

FIG. 7 shows one embodiment for the locating clip 60 which comprises a central section 114 having a hole 115 which accommodates the bolt 58 such as shown in FIGS. 6 and 8. From the central section 114 there are oppositely disposed pairs of ears including a first pair 116, 117 and a second pair 118, 119. As clearly indicated in FIG. 8, the pair 116, 117 are aligned in adjacent grooves 90 of the purlins. Similarly, the other pair 118, 119 is disposed within the elongated groove 56 of one of the rafters. Thus, the locating pin 60 is fixed to the rafter and interlocks the purlins with the rafter by virtue of the ears 116 and 117 that extend into the elongated grooves 90 in the purlins. Thus, with the use of a single simply constructed locating pin the rafter and a pair of purlins are effectively interlocked. Furthermore, this is accomplished without the requirement for any special notching in any of the rafters or purlins.

Figure 9:
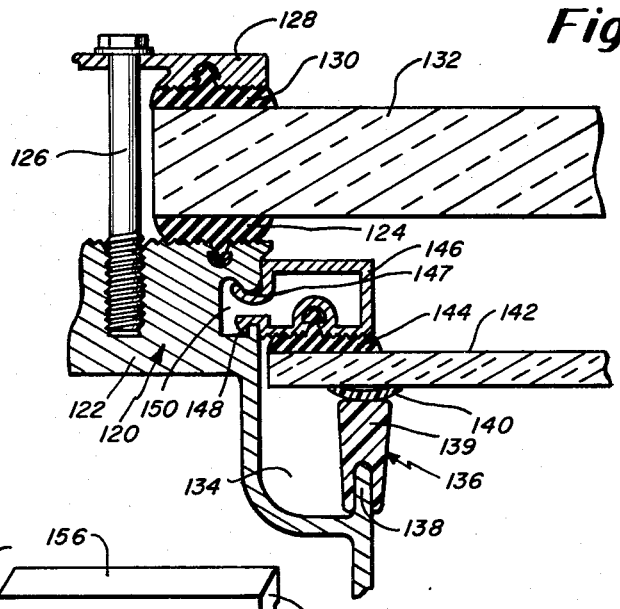
FIG. 9 is a fragmentary view of a segment of a rafter showing the type of construction and support for a double glazing panel construction.

FIG. 9 is a fragmentary view of a segment of a rafter showing the type of construction and support for a double glazing panel construction. Thus, in FIG. 9 there is shown a segment of the rafter 120 including the top flange 122 adapted to receive a gasket 124 and also the securing bolt 126. The bolt 126 also passes through a retainer 128 which supports a further cup-shaped gasket 130. There is provided a top glazing panel 132 supported between the gaskets 124 and 130 by means of the retainer 128. The rafter also includes the condensation gutter 134. In this connection there is provided a special support gasket 136 extending from the wall 138 forming a part of the condensation gutter. The member 136 comprises a relatively rigid tooth-shaped support member 139 having integrally supported therefrom at a top thereof a more resilient cup-shaped gasket 140 adapted to support thereabove a sub-glazing panel 142. The sub-glazing panel 142 is supported thereover by a second gasket 144 supported from a holding clip 146. The clip 146 has ends 147 and 148 adapted to be received in an aperture 150 of the rafter for retaining the clip 146 in position. The clip 146 may be constructed of an extruded aluminum and once forcibly clipped into place hold the sub-glazing panel in the proper position pressured against the gasket 140 supported thereunder.

Figure 10:
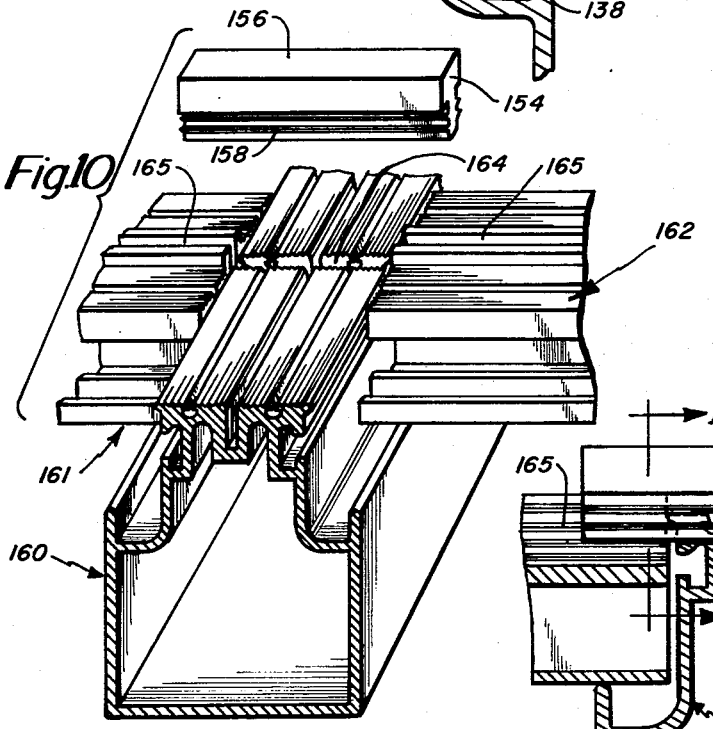
FIG. 10 is a perspective view similar to that shown in FIG. 8 and illustrating an alternate version of the locating clip.
Figure 11:
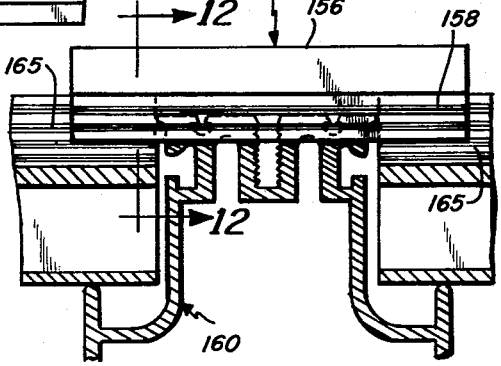
FIG. 11 is a cross-sectional view of the version of FIG. 10 showing the locating clip in position extending between adjacent purlins.
Figure 12:
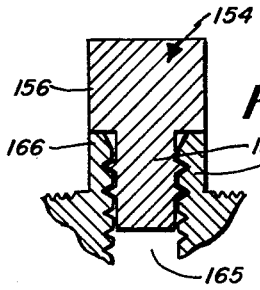
FIG. 12 is a cross-sectional view through the locating clip as taken along line 12—12 of FIG. 11.

FIGS. 10–12 show another alternate version for the rafter-to-purlin tie. This is in the form of a locating pin 154 which includes a top section 156 which is of generally square cross-section and a lower narrower ribbed section 158.

In FIGS. 10–12, the rafter and purlins are of substantially the same construction as described previously with regard to FIGS. 1–8. Thus, there is shown a rafter 160 which is substantially identical to the rafter 30 previously described. There are also shown pairs of adjacently disposed purlins 161, 162 which are substantially identical to the purlins shown previously such as the purlin 35 in FIG. 2. Similarly, the gasket and retainer arrangement described previously can also be used with the embodiment of FIGS. 10–12.

With the use of the locating pin 154, the purlins remain unaltered. However, the rafter is provided with a transverse channel 164 which is disposed at a position along the rafter where the purlin is to be secured. Thus, the channel 164 is adapted to align with the elongated grooves 165 in the adjacently disposed purlins 161, 162. FIG. 12 shows the upright walls 166 which define the elongated groove 165 into which the ribbed bottom section 158 of the locating pin is disposed. In FIGS. 10–12, the locating pin may be constructed of a rigid material. This could possibly be constructed of a rigid plastic although it is preferred that it be made of aluminum.

Having described a limited number of embodiments of the present invention, it should now be apparent to those skilled in the art that numerous other embodiments and modifications thereof are contemplated as falling within the scope of this invention. For example, the sub-glazing arrangement shown in FIG. 9 has been described in connection with a rafter, although, this could also be associated with other support members such as a curb frame. Also a similar type of support may be used in association with a purlin.

What is claimed is:

1. A skylight system comprising;

a rigid structural framework having a plurality of rafters, a plurality of purlins, means supporting the rafters in a generally parallel spacing with individual purlins extending between adjacently spaced rafters, and means retaining the purlins in fixed position relative to the rafters, glazing panels, and means for securing the glazing panels intermediate the rafters and purlins, said rafters having opposite side upright walls forming elongate condensation gutters on both sides of a rafter, said purlins adapted to rest at an end on the upright wall of the rafter, said retaining means comprising a locating means disposed at the intersection with the purlins and including means for engaging with the purlins to position and interlock the purlins in the proper position relative to the rafters and means separable from the rafter for securing the locating means to the rafter.

2. A skylight system as set forth in claim 1 wherein the rafters are of extruded metal construction, are hollow and have a centrally disposed glazing support flange extending above the condensation gutters.

3. A skylight system as set forth in claim 2 including an elongated gasket arranged between the flange support surface of the rafter and the glazing panel.

4. A skylight system as set forth in claim 3 wherein the top surface of the glazing support flange has an elongated groove to receive the locating means, said locating means being held to the rafter by a bolt secured to the rafter.

5. A skylight system as set forth in claim 4 wherein the locating means comprises a locating clip which is cross-shaped having a first set of legs in line and received in the elongated groove of the rafter, and a second set of legs also in line but extending orthogonally to the first set of legs and received in elongated grooves in respective purlins.

6. A skylight system as described in claim 5 wherein both purlins and rafters also have elongate channels for receiving gaskets for sealing between the rafters and purlins and the glazing panels.

7. A skylight system as described in claim 2 including a shoulder on the flange to prevent the purlin end from blocking water passage from the purlin gutter to rafter gutter.

8. A skylight system as described in claim 1 wherein the locating means comprises a locating clip which is cross-shaped having a first set of legs in line and coupled to the rafter and a second set of legs also in line but extending orthogonally to the first set of legs and coupled to the adjacent purlins, one leg of the second set coupled to one purlin and the other leg of the second set coupled to the adjacent purlin.

9. A skylight system as described in claim 8 wherein the rafters and purlins each having an elongated groove for receiving respective sets of legs of the locating clip.

10. A skylight system as described in claim 1 wherein the rafter has a transverse channel at a position therealong where the purlin is to be located with the locating means extending through the transverse channel to interlock at opposite ends with adjacent purlins on either side of the rafter.

11. A skylight system as described in claim 1 wherein the purlins each have a length on the order of the spacing between rafters, are of an extruded metal construction, and have a centrally disposed glazing support flange.

12. A skylight system as described in claim 11 wherein the purlins are of generally I-shape having a lower condensation gutter and the glazing support flange at the top thereof.

13. A skylight system as described in claim 12 including an elongated gasket arranged between the flange support surface of the purlin and the glazing panel.

14. A skylight system as described in claim 13 wherein the top surface of the glazing support flange has an elongated groove to receive the locating means.

15. A skylight system as described in claim 11 wherein the rafters are of extruded metal construction, are hollow and also have a centrally disposed glazing support flange extending above the rafter condensation gutters.

16. A skylight system as described in claim 1 wherein the glazing panels are single panels.

17. A skylight system as described in claim 1 wherein the glazing panels are double panels.

18. A skylight system as described in claim 1 including stop means between adjacent glazing panels.

19. A skylight system comprising;

a rigid structural framework having a plurality of rafters, a plurality of purlins, means supporting the rafters in a generally parallel spacing with individual purlins extending between adjacently spaced rafters, and means retaining the purlins in fixed position relative to the rafters, glazing panels, and means for securing the glazing panels intermediate the rafters and purlins, said rafters having opposite side upright walls forming elongate condensation gutters on both sides of a rafter, said purlins adapted to rest at an end on the upright wall of the rafter, said retaining means comprising a locating clip held to the rafter at the intersecton with the purlins and engaged with the purlins to position and interlock the purlins in the proper position relative to the rafters, said rafters being of extruded metal construction, being hollow and having a centrally disposed glazing support flange extending above the condensation gutters, an elongated gasket arranged between the flange support surface of the rafter and the glazing panel, the top surface of the glazing support flange having an elongated groove to receive the locating clip, said locating clip being held to the rafter by a bolt secured to the rafter.

20. A skylight system as set forth in claim 19 wherein the locating clip is cross-shaped having a first set of legs in line and received in the elongated groove of the rafter, and a second set of legs also in line but extending orthogonally to the first set of legs and received in elongated grooves in respective purlins ends.

21. A skylight system as set forth in claim 20 wherein both purlins and rafters also have elongated channels for receiving gaskets for sealing between the rafters and purlins and the glazing panels.

22. A skylight system comprising;

a rigid structural framework having a plurality of rafters, a plurality of purlins, means supporting the rafters in a generally parallel spacing with individual purlins extending between adjacently spaced rafters, and means retaining the purlins in fixed position relative to the rafters, glazing panels, and means for securing the glazing panels intermediate the rafters and purlins, said rafters having opposite side upright walls forming elongate condensation gutters on both sides of a rafter, said purlins adapted to rest at an end on the upright wall of the rafter, said retaining means comprising a locating clip held to the rafter at the intersecton with the purlins and engaged with the purlins to position and interlock the purlins in the proper position relative to the rafters, said locating clip being cross-shaped having a first set of legs in line and coupled to the rafter and a second set of legs also in line but extending orthogonally to the first set of legs and coupled to the adjacent purlins, one leg of the second set coupled to one purlin and the other leg of the second set coupled to the adjacent purlin.

23. A skylight system as described in claim 22 wherein the rafters and purlins each have elongated groove for receiving respective sets of legs of the locating clip.

24. A skylight system as set forth in claim 1 wherein said locating means has first means received by said rafter and second means extending substantially orthogonally to the first means and received by both adjacent purlins.

* * * * *